US006361434B1

(12) United States Patent
Brandon

(10) Patent No.: US 6,361,434 B1
(45) Date of Patent: Mar. 26, 2002

(54) ROLLABLE BAFFLE AND RIDGE VENT

(75) Inventor: Ralph Edwin Brandon, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/539,129

(22) Filed: Mar. 30, 2000

(51) Int. Cl.[7] ..... F24F 7/02
(52) U.S. Cl. ..... 454/365; 52/199
(58) Field of Search ..... 454/365; 52/199, 52/57

(56) References Cited

U.S. PATENT DOCUMENTS

| | | | | | |
|---|---|---|---|---|---|
| 3,660,955 | A | * | 5/1972 | Simon | 52/420 |
| 4,545,291 | A | * | 10/1985 | Kutsch et al. | 454/365 |
| 4,554,862 | A | * | 11/1985 | Wolfert | 454/365 |
| 4,643,080 | A | | 2/1987 | Trostle et al. | |
| 4,977,714 | A | * | 12/1990 | Gregory, Jr. | 52/95 |
| 5,002,816 | A | * | 3/1991 | Hofmann et al. | 428/138 |
| 5,095,810 | A | | 3/1992 | Robinson | |
| 5,122,095 | A | | 6/1992 | Wolfert | |
| 5,288,269 | A | | 2/1994 | Hansen | |
| 5,457,920 | A | | 10/1995 | Waltz | |
| 5,561,953 | A | | 10/1996 | Rotter | |
| 5,651,734 | A | | 7/1997 | Morris | |
| 5,673,521 | A | | 10/1997 | Coulton et al. | |
| 5,772,502 | A | | 6/1998 | Smith | |
| 5,797,222 | A | | 8/1998 | Martin | |
| 5,934,995 | A | * | 8/1999 | Morris et al. | 454/365 |
| 5,946,868 | A | | 9/1999 | Morris | |
| 5,947,817 | A | | 9/1999 | Morris et al. | |
| 6,233,887 | B1 | | 5/2001 | Smith | |
| 6,260,315 | B1 | | 7/2001 | Smith | |

* cited by examiner

*Primary Examiner*—Pamela Wilson
*Assistant Examiner*—Derek S. Boles
(74) *Attorney, Agent, or Firm*—Inger H. Eckert; James J. Dottavio

(57) ABSTRACT

A baffle adapted to be rolled with a ridge vent is comprised of an L-shaped configuration having first and second legs. The first leg is adapted to extend under the ridge vent. The second leg is adapted to be oriented at an angle relative to the first leg and some distance from the ridge vent when the baffle and the ridge vent are installed. The first leg is also adapted to be rolled. The second leg is adapted to collapse when the first leg is rolled. The invention is also directed towards a ridge vent in combination with the baffle and a method for forming the baffle.

26 Claims, 7 Drawing Sheets

ROLLABLE BAFFLE AND RIDGE VENT

TECHNICAL FIELD AND INDUSTRIAL APPLICABILITY OF THE INVENTION

The present invention relates to roof ventilating devices and, in particular, to roof ventilating devices comprised of a deflector that may be rolled up with a ridge vent.

BACKGROUND OF THE INVENTION

In the winter, normal household activities, such as laundering clothes, running dishwashers and taking showers, generate moisture that can damage the attic insulation and rafters as well as the roof deck, underlayment and shingles. In the summer, heat build-up can cause premature aging and cracking of wood and roofing materials.

Providing a balanced ventilation system in the attic can combat these problems. When a ventilation system is balanced, wind blowing over the roof ridge cap creates a negative pressure that draws warmer air out of the attic. Replacement air enters the attic through undereave vents, bathes the underside of the roof and exits at the ridge cap. Even in the absence of wind, the natural convection action of rising warm air maintains a continuous airflow along the underside of the roof. Such a system works year round with no moving parts or energy consumption.

In addition to having good ventilation for the attic space, ventilation systems should also prevent ingress of water and snow into the attic space. To this end, a solid, vertical exterior baffle runs parallel to the two sides of the ridge vent. The baffle deflects wind away from the ridge vent. Drain openings in the baffle allow moisture to escape.

Ridge vents can be transported and stored in a spiral conformation. The spiral conformation is achieved by rolling the ridge vent in a direction generally parallel to its longitudinal axis. One commonly known ridge vent includes a top panel and one or more lateral vents, rolled such that the more lateral vents are radially exposed. This ridge vent is installed quickly and easily.

The current baffle used with rolled ridge vent is a four-foot long stainless steel baffle that is packaged and sold separately and that is installed separately from the rolled ridge vent.

What is needed is a baffle that may be integral with a ridge vent so that the baffle may be rolled, packaged and sold with a ridge vent and installed with the ridge vent.

SUMMARY OF THE INVENTION

The present invention is directed towards a baffle that is adapted to be rolled with a ridge vent. The baffle is comprised of an L-shaped configuration having first and second legs. The said first leg is adapted to extend under the ridge vent. The second leg is adapted to be oriented at an angle relative to the first leg and some distance or spaced apart from the ridge vent when the baffle and the ridge vent are installed. The first leg is also adapted to be rolled. The second leg is adapted to collapse when the first leg is rolled. The invention is also directed towards a ridge vent in combination with the baffle and a method for forming the baffle.

Various objects and advantages of this invention will become apparent to those skilled in the art from the following detailed description of the preferred embodiment, when read in light of the accompanying drawings.

DETAILED DESCRIPTION AND THE PREFERRED EMBODIMENT OF THE INVENTION

Figure 1:
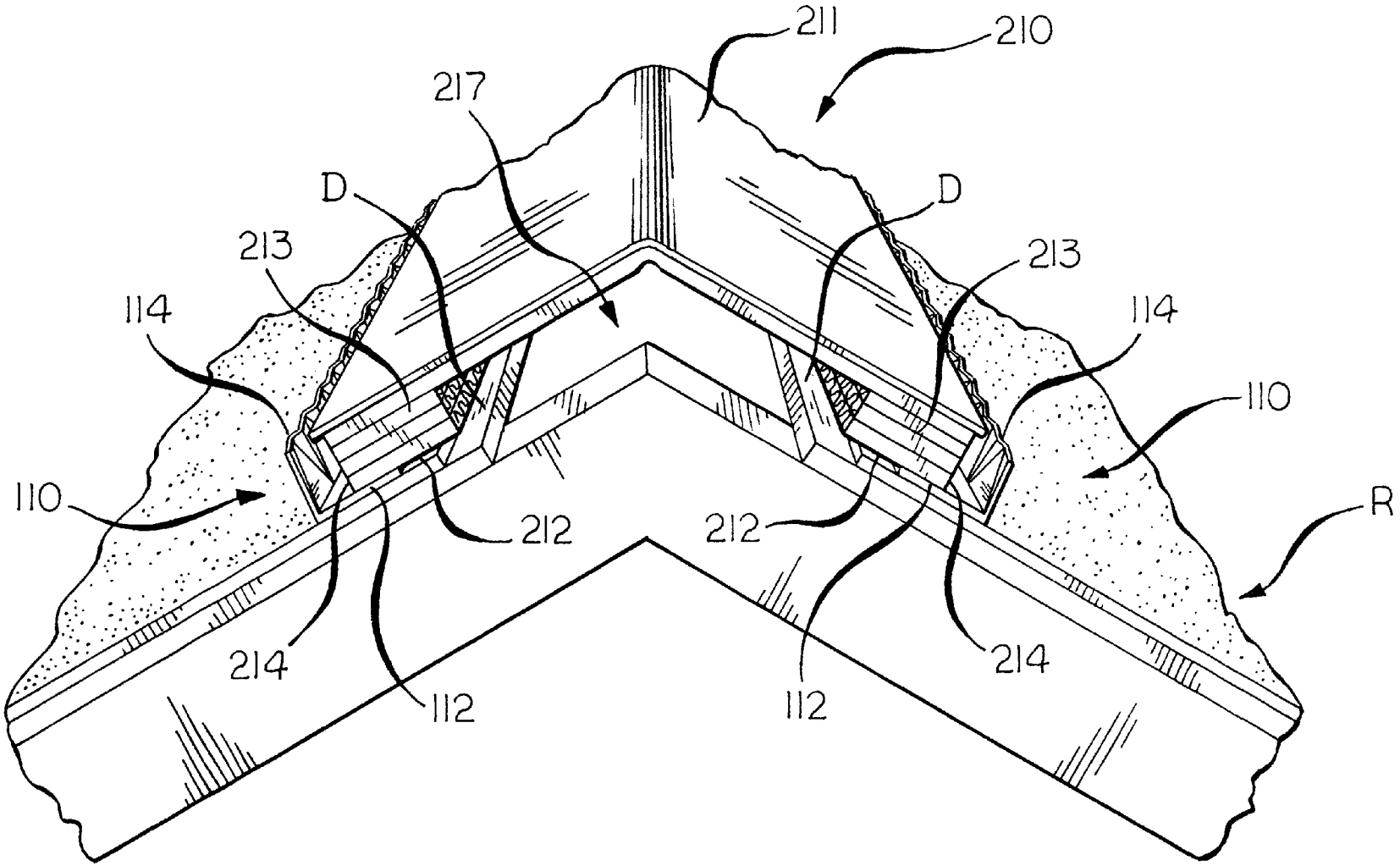
FIG. 1 is a partial side perspective view of a roof ridge, a ridge vent, and a baffle adapted to roll up with the ridge vent.

Referring now to the drawings, there is illustrated in FIG. 1 a ridge vent deflector or baffle 110 that can protect against wind, snow and rain. The baffle 110 is adapted to be rolled, packaged and sold with a ridge vent 210. The baffle 110 can also be installed with the ridge vent 210. The ridge vent 210 is commonly made of a weatherproof cap or cover 211 and a pair of opposing vent strips or vent members 213. The vent members 213 have air passages to allow air to pass from an attic through a roof deck opening 217 and through the vent members 213. Typically, the vent members 213 are corrugated to form air passages. The vent members 213 have a side 214 and a bottom 212.

The baffle 110 is preferably an L-shaped configuration comprising a first leg 112 and a second leg 114 intersecting the first leg 112. The first leg 112 is adapted to extend under the ridge vent 210. The second leg 114 is adapted to be oriented at an angle relative to the first leg 112 and some distance down slope of, or spaced apart from, the ridge vent 210 when the baffle 110 and ridge vent 210 are installed.

Figure 2:
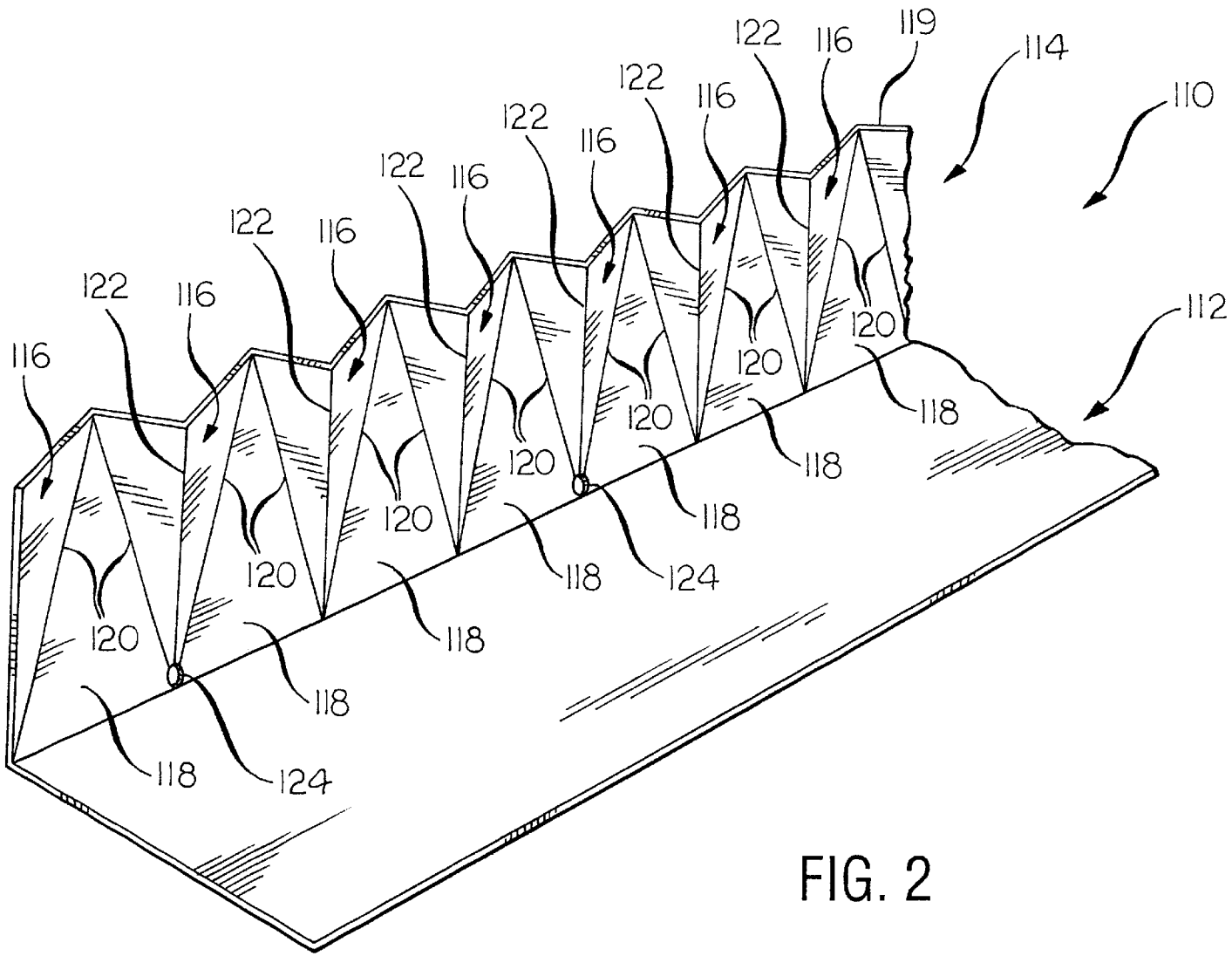
FIG. 2 is a partial perspective view of the baffle shown in FIG. 1.
Figure 3:
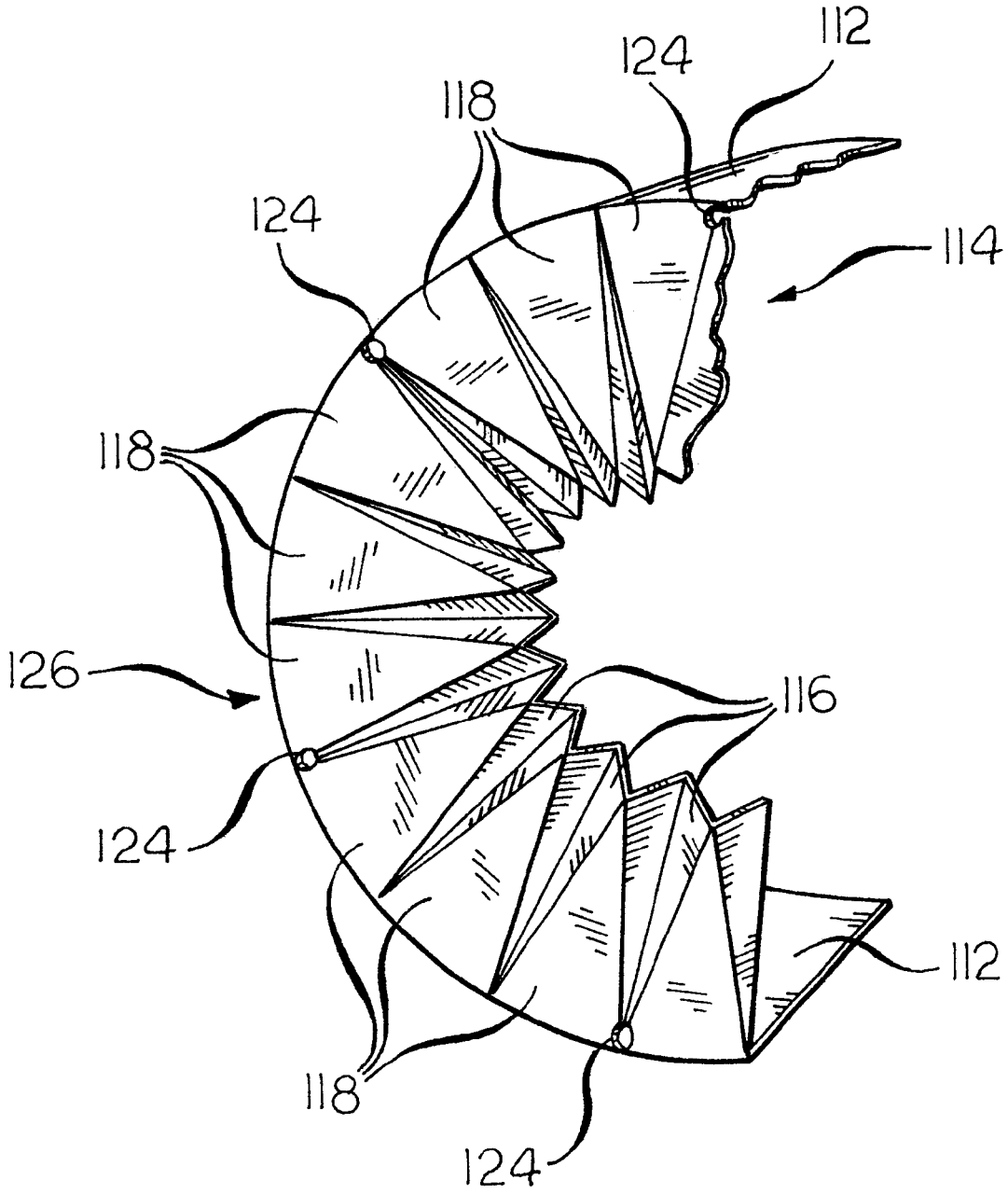
FIG. 3 is a partial perspective view of the baffle shown in FIG. 1 in a rolled condition.

The baffle 110 is preferably relatively thin. The thickness of the baffle 110 depends upon the material property of the baffle 110. The baffle 10 is most preferably sufficiently thick to withstand winds up to 120 miles per hour without folding. As shown in FIGS. 2 and 3, the first and second legs 112, 114 are preferably substantially planar and elongated. Although the angle between the first and second legs 112, 114 is preferably about 90 degrees, other angles may be suitable.

The first leg 112 of the baffle 110 is adapted to be rolled. The second leg 114 is adapted to collapse upon itself when the first leg 112 is rolled, as shown in FIG. 3. This is accomplished by dividing the second leg 114 into a plurality of deformed and non-deformed portions 116, 118. Upon rolling the first leg 112, the deformed portions 116 fold to permit adjacent non-deformed portions 118 to be drawn towards one another. Absent the deformed portions 116, the second leg 114 is effectively a beam that is not subject to roll upon rolling the first leg 112.

The deformed and non-deformed portions 116, 118 are preferably triangles. Complementary triangles appear to be the simplest shapes to form. As shown in FIGS. 2 and 3, the deformed portions 116 are represented as triangles having their apexes located at the edge of the second leg 114 intersecting the first leg 112. The non-deformed portions 118 are represented as triangles having their apexes located at the free or outer edge 119 of the second leg 114. Although triangles are shown, it is conceivable that other shapes may be suitable for carrying out the invention.

As shown in FIG. 2, the deformed portions 116 are formed by scoring the relatively thin baffle material at the edges 120 of the deformed portions 116 along the intersection of the deformed and non-deformed portions 116, 118 and further down the center 122 of the deformed portions 116. The score lines permit the deformed portions 116 to fold while drawing adjacent non-deformed portions 118 together, as shown in FIG. 3. This, in turn, reduces the circumference of the beam defined by the second leg 114, which allows the baffle 110 to be rolled.

Score lines are preferably embossed in the baffle material. The term embossing is understood to mean forming the score lines through the application of pressure or heat and pressure or removal of material. This may be accomplished using a heated rotary gear die, a stationary or traveling elongate linear stamp, or any other suitable tool. Embossing the baffle material with score lines preferably displaces or removes baffle material to form a hinge. Embossing the baffle material most preferably stretches the baffle material slightly so that all the deformed portions 116 are slightly non-coplanar with the non-deformed portions 118. In addition to being stretched by embossing the score lines, the deformed portions 116 may be slightly stretched to further ensure that the deformed portions 116 are slightly non-coplanar with the non-deformed portions 118.

Although the baffle preferably has score lines at opposing edges 120 and the center 122 of the deformed portion 116 to permit the baffle to be rolled, other lines may be suitable to permit the baffle 110 to be folded. For example, the baffle 110 may include corrugated lines instead of score lines. Regardless of their form, it is most preferable that the lines be straight because straight lines are adapted to fold whereas curved lines are not adapted to fold.

The baffle 110 preferably has drain openings 124 to allow moisture to escape. In particular, the drain openings 124 are provided in the second leg 114 adjacent the intersection of the first and second legs 112, 114. In this way, the drain openings 124 are located against the roof R (shown in FIG. 1) when the baffle 110 is installed. The drain openings 124 may be provided in the deformed portions 116, as shown, or the non-deformed portions 118.

The baffle 110 is preferably made of a material that is economical and efficient to extrude and that has weathering characteristics suitable to sustain extreme heat, wind and rain. Various base materials, such as metals, metal alloys, plastics, plastic blends or alloys, and composite materials, may be suitable for forming an extruded baffle 110. Thermal plastic materials, such as polyolefins (e.g., polyethylene and polypropylene), polystyrene, polyester, polycarbon, polyvinylchloride, polyurethane, or nylon, may prove to be more efficient and economical to extrude. Some materials may not have optimum color, impact resistance, or weathering characteristics. Additives, such as colorants, impact modifiers, or ultra violet (UV) inhibitors, may improve such materials. A preferred embodiment of the invention may include a colorized, UV stabilized, high density polypropylene.

If desired, portions of the extrusion may vary in thickness. For example, the thickness of the extrusion may vary so that the legs 112, 114 of the baffle 110 vary in thickness relative to one another. Alternatively, the thickness of the extrusion may vary so that the legs 112, 114 of the baffle 110 taper. For example, it may be desirable for the free edges of the legs 112, 114 to be thinner than the intersecting edges of the legs 112, 114.

The baffle 110 does not have to be extruded. Instead, the baffle 110 may be formed from a flat strip that is bent in the shape of an "L" to form an L-shaped bent strip. Forming the baffle 110 from a flat material may be simpler and thus, more economical. However, forming the baffle 110 from a flat strip may pose a disadvantage. A flat material that is bent may retain a memory component that induces the material to return to its flat condition, especially when subjected to extreme heat, wind and rain. This disadvantage may be overcome by bending the strip in a thermal forming process. In the thermal forming process, the baffle material is heated beyond its softening point and then bent. In this way, the bent material has no memory of being flat.

A baffle 110 can be formed from various metals, metal alloys, plastics and composite materials. The deformed portions 116 may be formed in a post process, after the L-shaped baffle 110 is formed. Alternatively, the score lines may be pre-formed in a flat strip of material and the flat strip may be bent in a post process. Pre-forming the score lines may be a more economical and efficient manner of forming the baffle 110 than providing score lines in a pre-bent material because forming score lines in a flat strip may prove to be easier than forming score lines in a strip that has been pre-bent.

Figure 4:
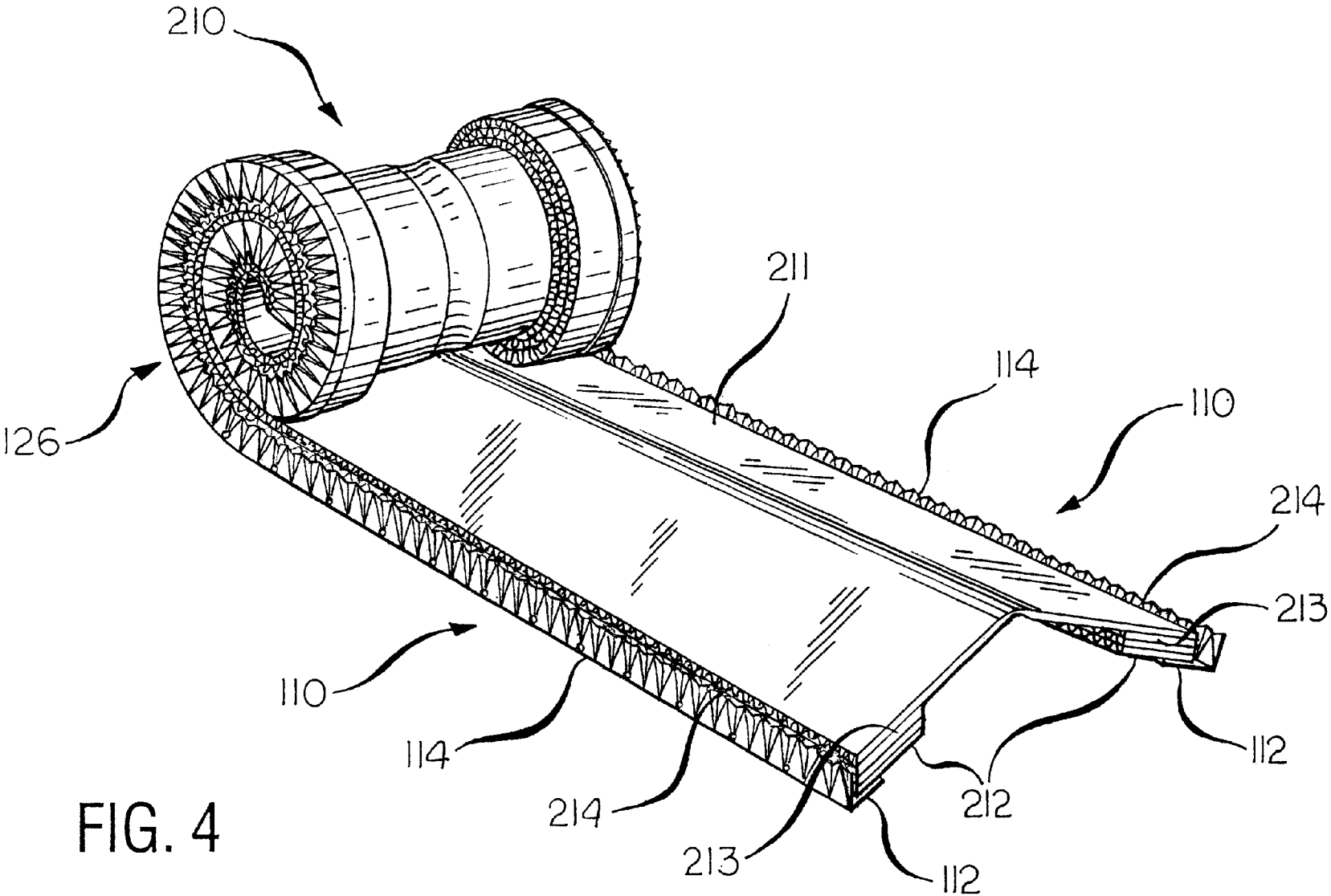
FIG. 4 is a perspective view of the ridge vent and the baffle shown in FIG. 1 in a partially rolled condition.

The baffle 110 and the ridge vent 210 can be assembled together as a single piece assembly, as shown in FIG. 4. For example, the baffle 110 and the ridge vent 210 may first be formed independently of one another. In a post-process, the independently formed baffle 110 and ridge vent 210 may be attached together. The baffle 110 and the ridge vent 210 may be attached together in any suitable manner. For example, the baffle 110 and the ridge vent 210 may be attached together by welding or thermal spotting, or with mechanical fasteners or adhesive.

The first leg 112 of the baffle 110 is attached to the bottom 212 of the ridge vent 210 so that the second leg 114 extends some distance in front of the side 214 of the ridge vent 210. The second leg 114 is preferably dimensioned to extend upwardly beyond the side 214 of the ridge vent 210.

The first leg 112 of the baffle 110 is preferably 2 to 2½ inches in width. This permits 1½ inches of the first leg 112 to be attached to the ridge vent 210 with the remaining inch to extend outwardly beyond the side 214 of the ridge vent 210. The second leg 114 is preferably 1 to 1¼ inches in height to permit the free edge 119 of the second leg 114 to extend upwardly beyond the cap 211 of the ridge vent 210.

In packaging the combined ridge vent 210 and baffle 110, the combination is rolled so that the baffle 110 is exposed. The deformed portions 116 of the baffle 110 are configured to fold inward in a space defined between the non-deformed portions 118 and the side 214 of the ridge vent 210. The non-deformed portions 118 are drawn towards one another to form a solid surface 126 for the rolled ridge vent 210 and baffle 110 to rest in its rolled and packaged condition.

In application, the combination is unrolled so that the baffle 110 is closest to the roof deck D, or between the deck D and the ridge vent 210, as shown in FIG. 1. The combination ridge vent 210 and baffle 110 are secured to the deck D by driving roofing nails (not shown) through the ridge vent 210 and baffle 110, and into the deck D.

The ridge vent 210 is capped with hip and ridge (not shown). The hip and ridge extends beyond the ridge vent 210 but spaced apart from the second leg 114 of the baffle 110. The space is provided to permit air to be vented through the ridge vent 210. Air is vented through the ridge vent 210 by thermal convection, by a vacuum created by wind blowing upwardly across the roof R further across the space between the second leg 112 of the baffle 110 and the side 213 of the ridge vent 210, or by attic exhaust or venting fans.

Figure 5:
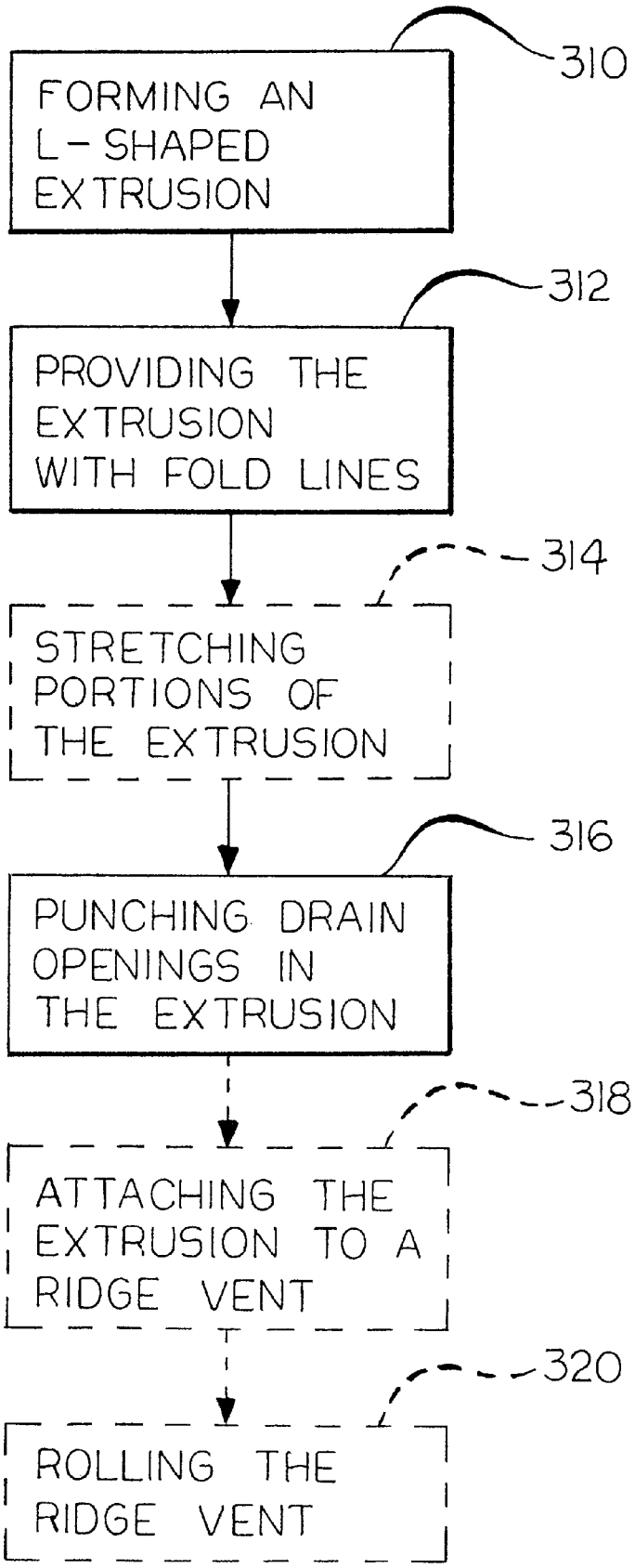
FIG. 5 is a flow chart representing a method for making a baffle in combination with a ridge vent.

A method of forming a baffle 110 comprises the step 310 of forming an L-shaped extrusion having first and second legs, as shown in FIG. 5. In function block 312, the extrusion is provided with fold lines. The fold lines may be provided by embossing score lines on the extrusion. Other suitable fold lines may be provided. For example, the extrusion may be folded along corrugations. In providing the fold lines, deformed portions 116 and non-deformed portions are formed. The deformed portions separate the non-deformed portions. The non-deformed portions are most preferably arranged in a co-planar arrangement. The deformed portions are most preferably all slightly folded inward so that the deformed portions are not co-planar with the non-deformed portions. In optional function block 314, the deformed portions are stretched to ensure that the deformed portions are not co-planar with the non-deformed portions. In function block 316, drain openings are punched in the second leg of the extrusion.

Figure 6:
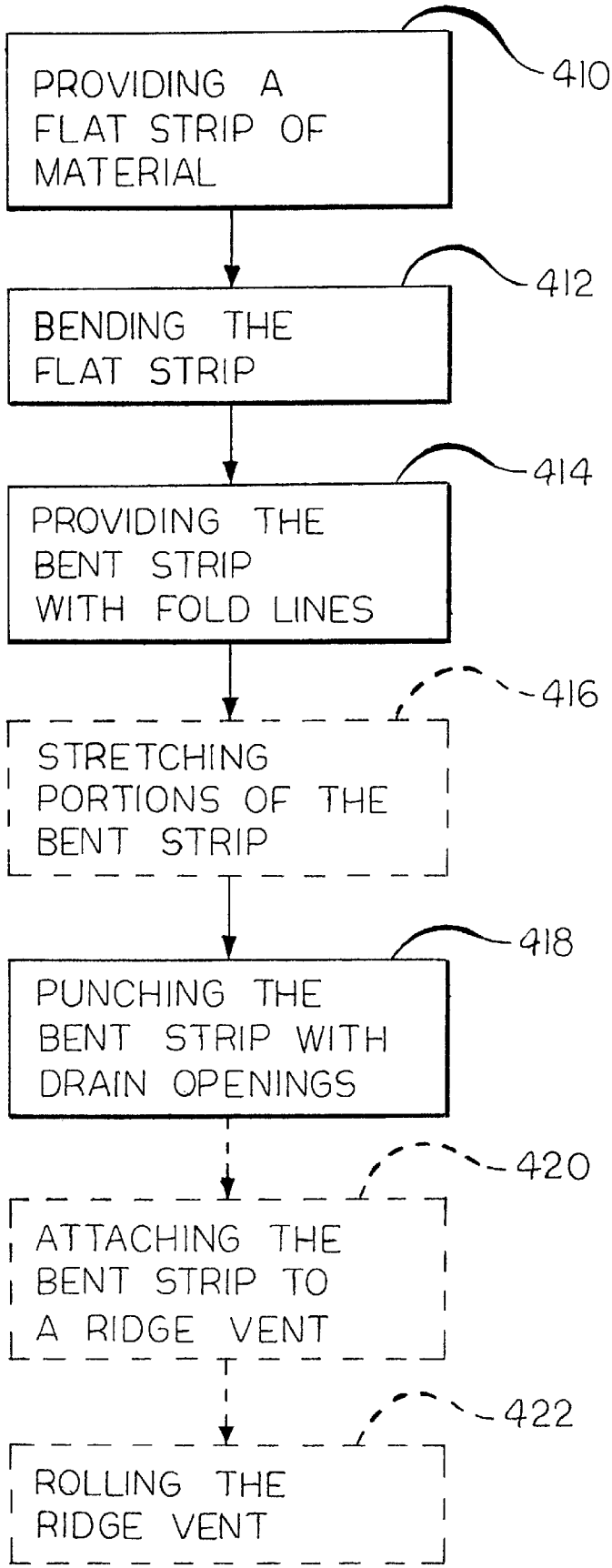
FIG. 6 is a flow chart representing another method for making a baffle in combination with a ridge vent.

In an alternative method, a flat strip of material is provided, as shown in function step 410 in FIG. 6. In function block 412, the flat strip of material is bent in the shape of an "L". Then, the bent strip is provided with fold lines in a post-form process to form deformed and non-deformed portions, as shown in function block 414. In optional function step 416, the deformed portions of the bent strip are stretched. Lastly, the bent strip is punched with drain openings, as shown in function block 418.

Figure 7:
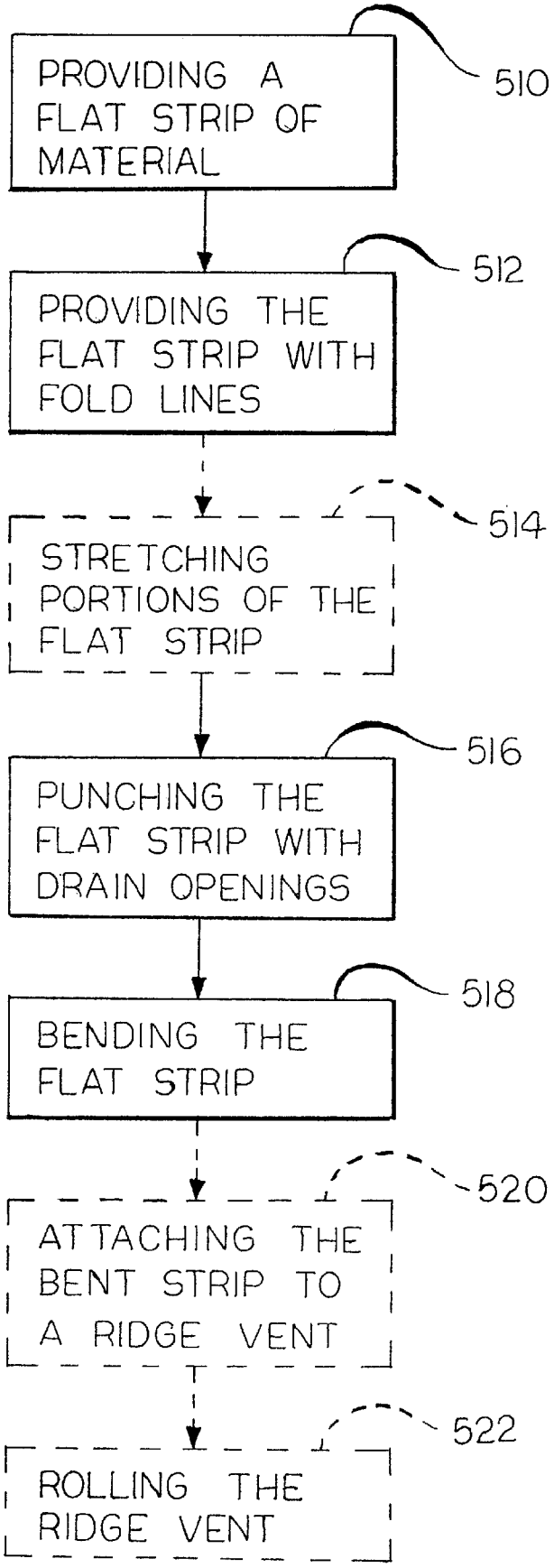
FIG. 7 is a flow chart representing an alternative method for making a baffle in combination with a ridge vent.

Alternatively, a flat strip of material is provided, as shown in function block 510 in FIG. 7. In function block 512, the flat strip is provided with fold lines to form deformed and non-deformed portions. In optional function block 514, the deformed portions of the flat strip are stretched. Next, the flat strip is punched with drain openings, as shown in function block 516. Finally, the flat strip is bent in the shape of an "L", as shown in function block 518.

Once formed, the baffle 110 may be attached to the bottom edge of a ridge vent 210, as shown in optional function blocks 318, 420, 520 in FIGS. 5–7. This may be accomplished by hot welding, ultrasonic welding, mechanical fasteners, such as staples, hot melt adhesives, reactive adhesives (e.g., epoxies, urethanes, solvent-based adhesives), or solvent welding. Subsequently, the ridge vent 210 and baffle 110 are to be rolled up and packaged, as shown in optional function blocks 320, 422, 522.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A baffle adapted to be rolled and packaged with a ridge vent, said baffle comprising:

an L-shaped configuration comprising a first leg and a second leg, said first leg being adapted to extend under the ridge vent, said second leg being adapted to be oriented at an angle relative to said first leg and positioned distance down slope of the ridge vent when said baffle and the ridge vent are installed; and said first leg being adapted to be rolled, said second leg being adapted to collapse upon rolling said first leg.

2. The baffle according to claim 1, wherein said second leg includes a plurality of deformed and non-deformed portions, said deformed portions capable of being folded to permit said non-deformed portions to be drawn towards one another upon rolling said first leg.

3. The baffle according to claim 2, wherein said deformed and non-deformed portions are triangles.

4. The baffle according to claim 3, wherein said triangles are complementary triangles.

5. The baffle according to claim 2, wherein said deformed portions are represented as triangles having apexes located at an intersection of said first and second legs and said non-deformed portions are represented as triangles having apexes located at a free edge of said second leg.

6. The baffle according to claim 2, wherein said deformed portions are formed by providing score lines in said second leg along an intersection of said deformed and non-deformed portions and further down the center of said deformed portions, said score lines permitting said deformed portions to fold while drawing said non-deformed portions together.

7. The baffle according to claim 6, wherein said score lines are embossed in said second leg.

8. The baffle according to claim 2, wherein said deformed portions are formed by corrugated lines.

9. The baffle according to claim 2, wherein said deformed portions are stretched.

10. The baffle according to claim 1, further including drain openings in said second leg adjacent an intersection of said first and second legs.

11. The baffle according to claim 1, wherein said L-shaped configuration is extruded from a thermal plastic material.

12. The baffle according to claim 11, wherein additives are added to said thermal plastic material.

13. The baffle according to claim 1, wherein said extrusion is a material selected from the group consisting of polyethylene, polypropylene, polystyrene, polyester, polycarbon, polyvinylchloride, polyurethane, or nylon.

14. The baffle according to claim 13, wherein additives are added to said extrusion material.

15. The baffle according to claim 1, wherein a flat strip is bent to form said L-shape configuration.

16. The baffle according to claim 15, wherein said flat strip is bent in a thermal forming process.

17. The baffle according to claim 15, wherein said flat strip is a metal or metal alloy.

18. The baffle according to claim 15, wherein said flat strip is a plastic.

19. In combination:

a ridge vent having a bottom and a side; and a baffle comprising an L-shaped configuration comprising a first leg and a second leg, said first leg being attached to said bottom of said ridge vent, said second leg being oriented at an angle relative to said first leg and some distance from said side of said ridge vent, said first leg being adapted to be rolled, said second leg collapsing upon rolling said first leg.

20. The combination according to claim 19, wherein said second leg of said baffle includes deformed and non-deformed portions, said ridge vent and said baffle being adapted to roll so that said baffle is exposed, said deformed portions being configured to fold inward in a space defined between said non-deformed portions and said side of said ridge vent.

21. The combination according to claim 20, wherein said non-deformed portions are drawn towards one another upon rolling said ridge vent and said baffle to form a solid surface for said rolled ridge vent and said baffle to rest.

22. The baffle according to claim 19, wherein said baffle is sufficiently thick to withstand winds up to 120 miles per hour without folding.

23. The baffle according to claim 19, wherein the angle between said first and second legs is about 90 degrees.

24. A method of forming a baffle comprising the steps of:

(a) forming an L-shaped extrusion having first and second legs;

(b) providing the extrusion with fold lines in the second leg of the extrusion;

(c) punching drain openings in the second leg of the extrusion;

(d) attaching the baffle to a bottom edge of a ridge vent; and (e) rolling up and packaging the ridge vent and baffle.

25. A method of forming a baffle comprising the steps of:

(a) providing a flat strip of material;

(b) bending the flat strip to form an L-shaped bent strip having first and second legs;

(c) providing the bent strip with fold lines in the second leg of the bent strip;

(d) forming the second leg of the bent strip with drain openings (e) attaching the baffle to a bottom edge of a ridge vent; and (f) rolling up and packaging the ridge vent and baffle.

26. A method of forming a baffle comprising the steps of:

(a) providing a flat strip of material;

(b) providing the flat strip with fold lines to form deformed and non-deformed portions;

(c) forming the flat strip with drain openings;

(d) bending the flat strip in the shape of an "L"

(e) attaching the baffle to a bottom edge of a ridge vent; and (f) rolling up and packaging the ridge vent and baffle.

* * * * *